US005691118A

United States Patent [19]

Haye

[11] Patent Number: 5,691,118

[45] Date of Patent: Nov. 25, 1997

[54] COLOR PAPER PROCESSING USING TWO ACIDIC STOP SOLUTIONS BEFORE AND AFTER BLEACHING

[75] Inventor: Shirleyanne E. Haye, Rochester, N.Y.

[73] Assignee: Eastman Kodak Company, Rochester, N.Y.

[21] Appl. No.: 728,813

[22] Filed: Oct. 10, 1996

[51] Int. Cl.[6] ..... G03C 7/407

[52] U.S. Cl. ..... 430/357; 430/393; 430/943

[58] Field of Search ..... 430/357, 393, 430/943

[56] References Cited

U.S. PATENT DOCUMENTS

| | | | |
|---|---|---|---|
| 4,277,556 | 7/1981 | Koboshi et al. | 430/393 |
| 4,301,236 | 11/1981 | Idota et al. | 430/393 |
| 4,454,224 | 6/1984 | Brien et al. | 430/393 |
| 4,717,649 | 1/1988 | Hall et al. | 430/460 |
| 5,541,041 | 7/1996 | Haye | 430/393 |
| 5,550,009 | 8/1996 | Haye et al. | 430/393 |

FOREIGN PATENT DOCUMENTS

| | | |
|---|---|---|
| 0 428 101 A1 | 11/1989 | European Pat. Off. . |
| 92/01972 | 7/1990 | WIPO . |
| 92/07300 | 10/1990 | WIPO . |

*Primary Examiner*—Hoa Van Le
*Attorney, Agent, or Firm*—J. Lanny Tucker

[57] ABSTRACT

Low silver color photographic papers are processed with separate bleaching and fixing steps wherein the bleaching solution is a peroxide solution. Prior to and after the bleaching step, and before fixing, the color papers are treated with acidic solutions to reduce blue record Dmin.

20 Claims, No Drawings

COLOR PAPER PROCESSING USING TWO ACIDIC STOP SOLUTIONS BEFORE AND AFTER BLEACHING

FIELD OF THE INVENTION

The present invention relates generally to the processing of color photographic papers. More particularly, it relates to the processing of color papers using two acidic stop solutions before and after peroxide bleaching to reduce Dmin stain.

BACKGROUND OF THE INVENTION

During processing of silver halide photographic elements, the developed silver is oxidized to a silver salt by a suitable bleaching agent. The oxidized silver is then removed from the element in a fixing step.

The most common bleaching solutions contain complexes of ferric ion and various organic ligands. One primary desire in this industry is to design bleaching compositions that are more compatible with the environment, and thus it is desirable to reduce or avoid the use of ferric complex bleaching agents.

Peracid bleaching solutions, such as those containing peroxide, persulfate, perborate, perphosphate, perhalogen, percarboxylic acid or percarbonate bleaching agents, offer an alternative to the ferric complex bleaching solutions. They are less expensive and present lower chemical and biological demands on the environment since their by-products can be less harmful.

While persulfate bleaching agents have low environmental impact, they have the disadvantage that their bleaching activity is slow and thus require the presence of a bleaching accelerator. The most common bleaching accelerators are thiols that have offensive odors.

Because hydrogen peroxide reacts and decomposes to form water, a peroxide based bleaching solution offers many environmental advantages over persulfate and ferric complex bleaching solutions. As a result, many publications describe peroxide bleaching solutions, including U.S. Pat. No. 4,277,556 (Koboshi et al), U.S. Pat. No. 4,301,236 (Idota et al), U.S. Pat. No. 4,454,224 (Brien et al), U.S. Pat. No. 4,717,649 (Hall et al), and WO-A-92/01972 (published Feb. 6, 1992).

In addition, WO-A-92/07300 (published Apr. 30, 1992) and EP 0 428 101A1 (published May 22, 1991) describe peroxide compositions for bleaching high chloride emulsions. These compositions comprise low amounts of chloride ions and have a pH in the range of 5 to 11. These particular bleaching solutions, however, cause vesiculation in the processed element. WO-A-93/11459 describes peroxide bleaching solutions that include two or more water-soluble sequestering agents for complexing with transition metals. These solutions appear to be suitable for use with low silver paper materials.

Improved peroxide bleaching solutions for both low and high chloride emulsions have been developed to provide improved bleaching efficiency and speed and reduced vesiculation obtained by including at least 0.35 mole of chloride ions per liter of solution.

In addition, U.S. Pat. No. 5,550,009 (Haye et al) and U.S. Pat. No. 5,541,041 (Haye) describe stabilized peroxide bleaching solutions having one or more sequestering agents, one of which is a pyridinecarboxylate, and the other is an organic phosphonic acid or salt thereof. These solutions have improved bleaching effectiveness and reduced vesiculation.

Color photographic papers are conventionally processed by either of two processes: conventional RA-4 employs a bleach-fixing step after color development. An optional process includes separate bleaching and fixing steps. While requiring additional processing steps, the optional process has some advantages. The separate bleaching and fixing process uses less iron complex bleaching agent and the fixer is easier to desilver without the iron complex present. Alternatively, persulfate or peroxide bleaching agents are more convenient replacements for the iron complexes, thereby lessening the environmental impact from the process.

However, there is also a concern in the industry that high blue Dmin (or yellow stain) in color papers may occur when separate bleaching and fixing steps are used in photoprocessing. Thus, there is a need in the art for a simple, effective and ecologically beneficial photoprocessing method for color photographic papers that provides desired color images with minimal blue Dmin stain.

SUMMARY OF THE INVENTION

We have found that the noted Dmin stain problem has been solved with a method for photoprocessing comprising, in order:

A) color developing an imagewise exposed color photographic paper comprising at least one predominantly silver chloride photographic emulsion, the paper having a total silver coverage of less than or equal to 1 $g/m^2$, B) stopping color development by contacting the paper with a first acidic solution having a pH of less than or equal to 5, C) bleaching the paper with a peroxide bleaching composition comprising a peroxide bleaching agent, and chloride ions, D) contacting the bleached paper with a second acidic solution having a pH of less than or equal to 5, and E) fixing the paper.

The photoprocessing method of this invention includes separate bleaching and fixing steps for providing desired color images in color photographic papers, and especially high silver chloride papers. A peroxide bleaching solution is used to provide a more ecologically beneficial process. This bleaching solution is also highly stabilized and exhibits reduced vesiculation because of the presence of chloride ion and/or specific sequestering agents. Moreover, because of the present invention, Dmin stain (especially blue record Dmin) is minimized. This advantage is provided by contacting the color papers before and after bleaching with separate acidic solutions (or acidic stop baths). The papers are then fixed in conventional fashion.

DETAILED DESCRIPTION OF THE INVENTION

The method of this invention is begun by color developing a color photographic paper using any of the conventional color developing solutions known in the art. Such solutions typically include one or more color developing agents, antioxidants (or preservatives), sequestrants, halides, buffers, and other addenda that would be known in the art. Particularly useful color developing agents include aminophenols and p-phenylenediamines, and particularly useful antioxidants include substituted and unsubstituted hydroxylamines, hydrazines, hydrazides, sulfites, alpha-amino acids, mono- and polysaccharides, and alcoholamines. By substituted hydroxylamines is meant, for example, those having one or more alkyl or aryl groups connected to the nitrogen atom. These alkyl or aryl groups can be further substituted with one or more groups such as sulfo, carboxy, carbamoyl, sulfamoyl, hydroxy, alkoxy, and other groups known in the art which provide solubilizing effects. Examples of such hydroxylamines are described, for example, in U.S. Pat. No. 4,876,174 (Ishikawa et al), U.S. Pat. No. 4,892,804 (Vincent et al), U.S. Pat. No. 5,178,992 (Yoshida et al), U.S. Pat. No. 5,354,646 (Kobayashi et al), U.S. Pat. No. 5,508,155 (Marrese et al), and WO US96/03016 (Eastman Kodak).

Development can also be carried out using what is known in the art as a "developer/amplifier" solution, as described in U.S. Pat. No. 5,324,624 (Twist).

The amounts of the components of the color developing solution would be those considered conventional in the art. Further details of useful color developing solutions are provided in *Research Disclosure*, cited below.

Following color development, the color photographic paper is subjected to the first acid treatment. This can occur by contacting the paper with an acidic solution having a pH of up to about 5, and preferably up to about 4. This solution can be simply a solution of one or more organic or inorganic acids that will suitably stop the activity of any color developing agent carried over from the color developing solution. Particularly useful acids include, but are not limited to, sulfuric acid, acetic acid, glycolic acid, maleic acid, propionic acid, nitric acid, methanesulfonic acid, citric acid, succinic acid, 2-chloropropionic acid, 3-chloropropionic acid and other inorganic or organic acid that has a pKa less than about 4. A preferred acid is sulfuric acid, methanesulfonic acid or acetic acid. The amount of acid can vary depending upon the pH desired and the strength of a given acid, but would be readily ascertained by a skilled worker in the art. The first acid solution can also include a biocide if desired.

Contact with the first acidic solution is generally for up to about 60 seconds (although it could be longer), and preferably, from about 20 to about 45 seconds, and more preferably about 30 seconds. The temperature of the solution is generally from about 20° to about 40° C.

Following this step, the paper is bleached using a peroxide bleaching solution. Peroxide bleaching solutions useful in this invention contain a conventional peroxide bleaching agent including, but not limited to hydrogen, alkali and alkaline earth salts of peroxide, or a compound which releases or generates hydrogen peroxide. Such hydrogen peroxide precursors are well known in the art, and include for example, perborate, perphosphate, percarbonate, percarboxylate, and hydrogen peroxide urea. Such precursors do not include persulfates. In addition, hydrogen peroxide can be generated in situ by electrolysis of an aqueous solution. Examples of peroxide bleaching solutions are described, for example, in *Research Disclosure*, publication 36544, pages 501–541 (September 1994). *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). This reference will be referred to herein as "*Research Disclosure*". Hydrogen peroxide is a preferred bleaching agent.

The amount of hydrogen peroxide (or its precursor) is generally at least 0.15 mol/l , and from about 0.15 to about 3 mol/l is preferred.

The peroxide bleaching solution also include chloride ions supplied as part of a simple inorganic salt for example, sodium chloride, potassium chloride, ammonium chloride and lithium chloride. In addition, they can be supplied as organic complexes such as tetraalkylammonium chlorides. The preferred salts are potassium and sodium chlorides.

The chloride ion concentration can be at any desirable concentration, and is generally at least about 0.01 mol/l, and more likely from about 0.05 to about 1 mol/l.

The bleaching solutions of this invention are quite simple, having only the two essential components described above. However, in preferred embodiments, they also include one or more distinct sequestering agents, as defined below. Another optional and preferred component is a buffer.

The bleaching solution is alkaline, having a pH within the general range of from about 7 to about 13, with a pH of from about 8 to about 12 being preferred, and a pH of from about 9 to about 11 being most preferred. The pH can be provided by adding a conventional weak or strong base, and can be maintained by the presence of one or more suitable buffers including, but not limited to, sodium carbonate, potassium carbonate, sodium borate, potassium borate, sodium phosphate, calcium hydroxide, sodium silicate, β-alaninediacetic acid, arginine, asparagine, ethylenediamine, ethylenediaminetetraacetic acid, ethylenediaminedisuccinic acid, glycine, histidine, imidazole, isoleucine, leucine, methyliminodiacetic acid, nicotine, nitrilotriacetic acid, piperidine, proline, purine and pyrrolidine. Sodium and potassium carbonates are preferred. The amount of useful buffer or base would be readily apparent to one skilled in the art.

One optional but preferred sequestering agent is an organic phosphonic acid or salt thereof. Generally such compounds are represented by the structure (I):

$$R^1N(CH_2PO_3M_2)_2$$

or (II):

$$R^2R^3C(PO_3M_2)2$$

wherein $R^1$ is hydrogen, a substituted or unsubstituted alkyl group of 1 to 12 carbon atoms (such as methyl, hydroxymethyl, ethyl, isopropyl, t-butyl, hexyl, octyl, nonyl, decyl, benzyl, 4-methoxybenzyl, β-phenethyl, o-octamidobenzyl or β-phenethyl), a substituted or unsubstituted alkylaminoalkyl group (wherein the alkyl portion of the group is an defined above, such as methylaminomethyl or ethylaminoethyl), a substituted or unsubstituted alkoxyalkyl group of 1 to 12 carbon atoms (such as methoxymethyl, methoxyethyl, propoxyethyl, benzyloxy, methoxymethylenemethoxymethyl, or t-butoxy), a substituted or unsubstituted cycloalkyl group of 5 to 10 carbon atoms (such as cyclopentyl, cyclohexyl, cyclooctyl or 4-methylcyclohexyl), a substituted or unsubstituted aryl group of 6 to 10 carbon atoms (such as phenyl, xylyl, tolyl, naphthyl, p-methoxyphenyl or 4-hydroxyphenyl), or a substituted or unsubstituted 5-to 10-membered heterocyclic group having one or more nitrogen, oxygen or sulfur atoms in the ring besides carbon atoms [such as pyridyl, primidyl, pyrrolyldimethyl, pyrrolyldibutyl, benzothiazolylmethyl, tetrahydroquinolylmethyl, 2-pyridinylmethyl, 4-(N-pyrrolidino)butyl or 2-(N-morpholino)ethyl].

$R^2$ is hydrogen, a substituted or unsubstituted alkyl group of 1 to 12 carbon atoms (as defined above), a substituted or unsubstituted aryl group of 6 to 10 carbon atoms (as defined above), a substituted or unsubstituted cycloalkyl group of 5 to 10 carbon atoms (as defined above), a substituted or unsubstituted 5- to 10-membered heterocyclic group (as defined above), $—PO_3M_2$ or $—CHR^4PO_3M_2$.

$R^3$ is hydrogen, hydroxyl, a substituted or unsubstituted alkyl group of 1 to 12 carbon atoms (defined above) or $—PO_3M_2$.

$R^4$ is hydrogen, hydroxyl, a substituted or unsubstituted alkyl group of 1 to 12 carbon atoms (as defined above) or $—PO_3M_2$.

M is hydrogen or a water-soluble monovalent cation imparting water-solubility such as an alkali metal ion (for example sodium or potassium), or ammonium, pyridinium, triethanolammonium, triethylammonium ion or others readily apparent to one skilled in the art. The two cations in each molecule do not have to be the same. Preferably, M is hydrogen, sodium or potassium.

In defining the substituted monovalent groups herein, useful substituents include, but are not limited to, an alkyl group, hydroxy, sulfo, carbonamido, sulfonamido, sulfamoyl, sulfonato, thioalkyl, alkylcarbonamido, alkylcarbamoyl, alkylsulfonamido, alkylsulfamoyl, carboxyl, amino, halo (such as chloro or bromo) sulfono, or sulfoxo, alkoxy of 1 to 5 carbon atoms (linear or branched), $—PO_3M_2$, $—CH_2PO_3M_2$ or $—N(CH_2PO_3M_2)_2$ wherein the alkyl (linear or branched) for any of these groups has 1 to 5 carbon atoms.

Representative phosphonic acids useful in the practice of this invention include, but are not limited to the compounds listed in EP 0 428 101A1 (page 4). Representative useful compounds are 1-hydroxyethylidene-1,1-diphosphonic acid, diethylenetriaminepentaphosphonic acid, ethylenediamine-N,N,N',N'-tetramethylenephosphonic acid, nitrilo-N,N,N-trimethylenephosphonic acid, 1,2-cyclohexanediamine-N,N,N',N'-tetramethylenephosphonic acid, o-carboxyaniline-N,N-dimethylenephosphonic acid, propylamine-N,N-dimethylenephosphonic acid, 4-(N-pyrrolidino)butylamine-N,N-bis(methylenephosphonic acid), 1,3-diamino-2-propanol-N,N,N',N'-tetramethylenephosphonic acid, 1,3-propanediamine-N,N,N',N'-tetramethylenephosphonic acid, 1,6-hexanediamine-N,N,N',N'-tetramethylenephosphonic acid, o-acetamidobenzylamine-N,N-dimethylenephosphonic acid, o-toluidine-N,N-dimethylenephosphonic acid, 2-pyridinylmethylamine-N,N-dimethylenephosphonic acid, 1-hydroxyethane-1,1-diphosphonic acid, diethylenetriamine-N,N,N',N",N"-penta (methylenephosphonic acid), 1-hydroxy-2-phenylethane-1,1-diphosphonic acid, 2-hydroxyethane-1,1-diphosphonic acid, 1-hydroxyethane-1,1,2-triphosphonic acid, 2-hydroxyethane-1,1,2-triphosphonic acid, ethane-1,1-diphosphonic acid, and ethane-1,2-diphosphonic acid, or salts thereof.

Particularly useful are 1-hydroxyethylidene-1,1-diphosphonic acid, nitrilo-N,N,N-trimethylenephosphonic acid, diethylenetriamine-N,N,N',N",N"-penta (methylenephosphonic acid), or salts thereof. The first compound is most useful.

The amount of organic phosphonic acid used in the practice of the invention is at least about 0.0005 mol/l and generally up to about 0.03 mol/l . An amount of from about 0.0025 to about 0.012 mol/l is preferred.

A second useful sequestering agent is a polyaminocarboxylic acid that has at least one secondary amino group at a pH of from about 8 to about 11. The compound also has at least two carboxyl Groups (polydentate), or their corresponding salts. Such acids can be bidendate, tridentate, tetradentate, pentadentate and hexadentate ligands. These acids must be water-soluble also, and are preferably biodegradable (defined below).

More specifically, these compounds include, but are not limited to, alkylenediaminetetracarboxylic acids having at least one secondary nitrogen atom, and alkylenediaminepolycarboxylic acids having at least one secondary nitrogen atom.

Representative useful classes of such acidic compounds are defined below in reference to structures (III)–(VII), although it should be recognized that the invention is not limited in practice to these compounds.

Thus, the compounds can have any of the following structures:

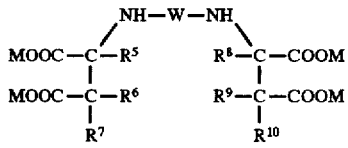

(III)

wherein $R^5$, $R^6$, $R^7$, $R^8$, $R^9$ and $R^{10}$ are independently hydrogen, hydroxy, a linear or branched substituted or unsubstituted alkyl group of 1 to 5 carbon atoms (such as methyl, ethyl, propyl, isopropyl, n-pentyl, t-butyl and 2-ethylpropyl), a substituted or unsubstituted cycloalkyl group of 5 to 10 carbon atoms in the ring (such as cyclopentyl, cyclohexyl, cycloheptyl and 2,6-dimethylcyclohexyl), or a substituted or unsubstituted aryl group having 6 to 10 carbon atoms in the aromatic nucleus (such as phenyl, naphthyl, tolyl and xylyl), M is as defined above, W is a covalent bond or a divalent substituted or unsubstituted aliphatic linking group (defined below),

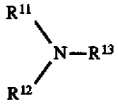

(IV)

wherein at least two of $R^{11}$, $R^{12}$ and $R^{13}$ are a carboxymethyl groups (or equivalent salts), and the third group is hydrogen,

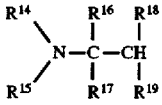

(V)

wherein one of $R^{14}$ and $R^{15}$ is hydrogen and the other is substituted or unsubstituted carboxymethyl group (or equivalent salts) or 2-carboxyethyl group (or equivalent salts), and $R^{16}$, $R^{17}$, $R^{18}$ and $R^{19}$ are independently hydrogen, a substituted or unsubstituted alkyl group of 1 to 5 carbon atoms (as defined above), hydroxy, carboxy, carboxymethylamino, or a substituted or unsubstituted carboxymethyl group (or equivalent salts), provided that only one of $R^{16}$, $R^{17}$, $R^{18}$ and $R^{19}$is carboxy, carboxymethylamino, or a substituted or unsubstituted carboxymethyl group (or equivalent salts),

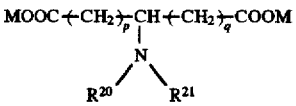

(VI)

wherein one of $R^{20}$ and $R^{21}$ is hydrogen and the other is a substituted or unsubstituted alkyl group of 1 to 5 carbon atoms (as defined above), substituted or unsubstituted hydroxyethyl Group, substituted or unsubstituted carboxymethyl or 2-carboxyethyl group (or equivalent salts), M is as defined above, and p and q are independently 0, 1 or 2 provided that the sum of p and q does not exceed 2, or

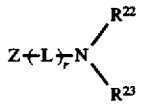

(VII)

wherein

Z represents a substituted or unsubstituted aryl group of 6 to 10 carbon atoms in the nucleus (as defined above) or a substituted or unsubstituted heterocyclic group having 5 to 7 carbon, nitrogen, sulfur and oxygen atoms in the nucleus (such as furanyl, thiofuranyl, pyrrolyl, pyrazolyl, triazolyl, dithiolyl, thiazolyl, oxazoyl, pyranyl, pyridyl, piperidinyl, pyrazinyl, triazinyl, oxazinyl, azepinyl, oxepinyl and thiapinyl), L is a divalent substituted or unsubstituted aliphatic linking group (defined below), one of $R^{22}$ and $R^{23}$ is hydrogen and the other is a substituted or unsubstituted alkyl group of 1 to 5 carbon atoms (as defined above), a substituted or unsubstituted carboxyalkyl group of 2 to 4 carbon atoms (such as substituted or unsubstituted carboxymethyl or carboxyethyl or equivalent salts) or a hydroxy-substituted carboxyalkyl group of 2 to 4 carbon atoms (or equivalent salts), and r is 0 or 1.

The "divalent substituted or unsubstituted aliphatic linking group" in the definition of "W" and "L" noted above includes any nonaromatic linking group comprised of one or more alkylene, cycloalkylene, oxy, thio, amino or carbonyl groups that form a chain of from 1 to 6 atoms. Examples of such groups include, but are not limited to, alkylene, alkyleneoxyalkylene, alkylenecycloalkylene, alkylenethioalkylene, alkyleneaminoalkylene, alkylenecarbonyloxyalkylene, all of which can be substituted or unsubstituted, linear or branched, and others that would be readily apparent to one skilled in the art.

In defining the "substituted or unsubstituted" monovalent and divalent groups for the structures noted above, by "substituted" is meant the presence of one or more substituents on the group, such as an alkyl group of 1 to 5 carbon atoms (linear or branched), hydroxy, carboxy, sulfo, sulfonato, thioalkyl, alkylcarbonamido, alkylcarbamoyl, alkylsulfonamido, alkylsulfamoyl, carbonamido, sulfonamido, sulfamoyl, amino, halo (such as chloro or bromo), sulfono (—$SO_2R$) or sulfoxo [—S(O)R] wherein R is a branched or linear alkyl group of 1 to 5 carbon atoms.

In reference to the foregoing structures (III)–(VII), preferred definitions of groups are as follows:

M is hydrogen, ammonium, lithium, sodium or potassium, $R^5$, $R^6$, $R^7$, $R^8$, $R^9$ and $R^{10}$ are independently hydrogen, hydroxy or methyl, W is a covalent bond or a substituted or unsubstituted alkylene group of 1 to 3 carbon atoms, one of $R^{14}$ and $R^{15}$ is carboxymethyl, $R^{16}$, $R^{17}$, $R^{18}$ and $R^{19}$ are independently hydrogen, carboxymethyl or carboxy, one of $R^{20}$ and $R^{21}$ is methyl or carboxymethyl, Z represents 2-pyridyl or 2-imidazolyl, L is substituted or unsubstituted alkylene of 1 to 3 carbon atoms, one of $R^{22}$ and $R^{23}$ is 2-carboxyethyl or carboxymethyl, and r is 1.

More preferred second sequestering agents are N,N-ethylenediaminedisuccinic acid, N,N-ethylenediaminediacetic acid, and N-(2-carboxyethyl) aspartic acid.

Besides those compounds specifically defined in the foregoing description, there is considerable literature that describes additional useful acidic sequestering agents, such as EPA 0 567 126 (Seki et al), U.S. Pat. No. 5,250,401 (Okada et al) and U.S. Pat. No. 5,250,402 (Okada et al), as long as the compounds have a secondary amino group at a pH of from about 8 to about 11.

The one or more second sequestering agents are present in the bleaching solution in an amount of at least about 0.0005 mol/l. Preferred amounts are from about 0.001 to about 0.05 mol/l, and more preferred amounts are from about 0.002 to about 0.01 mol/l.

Many of the first and second sequestering agents described herein are commercially available (such as from Dow Chemical Company or Sigma Chemical Company), or can be prepared by methods known to those skilled in the art.

Mixtures of each type of sequestering agent can be used if desired, and one or more of each of the first and second sequestering agents can be used for optimum stabilization of the bleaching solution.

As used herein, the terms "biodegradable" or "biodegradability" refer to at least 80% decomposition in the standard test protocol specified in by the Organization for Economic Cooperation and Development (OECD), Test Guideline 302B (Paris, 1981), also known as the "Modified Zahn-Wellens Test".

Following bleaching, the paper is subjected to a second acidic treatment. The second acidic solution can be of the same or different composition as the first acidic solution. Thus, the acids used in both acidic solutions can be the same or different. Representative acids are as described above, and a preferred acid is sulfuric acid, acetic acid or methanesulfonic acid. The second acidic solution has a pH of 5 or less, and preferably, it has a pH of about 4 or less.

Treatment with the second acidic solution is generally for less than about 90 seconds (but can be longer if desired), and preferably from about 20 to about 45 seconds. The solution temperature is generally from about 20° to about 40° C.

Fixing of the paper can be accomplished using any suitable fixing solution containing a suitable fixing agent. Representative fixing agents are described in *Research Disclosure*, noted above. Preferred fixing agents include thioethers and thiosulfates. The components of the fixing solutions are present in conventional amounts.

The color photographic papers to be processed using the present invention can contain one or more of the conventional silver halide emulsions as long as at least one emulsion is a predominantly silver chloride emulsion, meaning it has at least 50 mol % silver chloride. The other emulsions in the paper can be the same or different, but preferably, all of the emulsions in the papers are predominantly silver chloride. Thus, the red, green and blue color records each have at least one predominantly silver chloride emulsion. More preferably, each emulsion has at least 90 mol % silver chloride, and most preferably, each emulsion has at least 95 mol % silver chloride. The predominantly silver chloride emulsions contain substantially no silver iodide, meaning less than 5 mol % of silver iodide, and preferably no silver iodide. Any remaining silver halide in the emulsions is thus silver bromide.

The photographic papers processed in the practice of this invention can be single or multilayer color papers. Multilayer color papers typically contain dye image-forming units sensitive to each of the three primary regions of the visible spectrum. Each unit can be comprised of a single emulsion layer or multiple emulsion layers sensitive to a given region of the spectrum. The layers of the paper can be arranged in any of the various orders known in the art. In an alternative format, the emulsions sensitive to each of the three primary regions of the spectrum can be disposed as a single segmented layer. The papers can also contain other conventional layers such as filter layers, interlayers, subbing layers, overcoats and other layers readily apparent to one skilled in the art.

Considerably more details of the paper structure and components are described in *Research Disclosure*, noted above. All types of emulsions can be used in the elements, including but not limited to, thin tabular grain emulsions, and either positive-working or negative-working emulsions.

The papers used in this invention also have low total silver coverage, that is up to about 1 g/m$^2$.

The papers are typically exposed to suitable radiation to form a latent image and then processed as described above to form a visible dye image. The fixing step described above can be followed by one or more washing and/or stabilizing steps, then drying to provide the desired image.

Processing according to the present invention can be carried out using conventional deep tanks holding processing solutions. Alternatively, it can be carried out using what is known in the art as "low volume thin tank" processing systems having either rack and tank or automatic tray designs. Such processing methods and equipment are described, for example, in U.S. Pat. No. 5,436,118 (Carli et al) and publications noted therein.

The following examples are presented to illustrate the practice of this invention, and are not intended to be limiting in any way. Unless otherwise indicated, all percentages are by weight.

Comparison methods D–J (TABLE III) utilized the same protocol of TABLE I, but with a hydrogen peroxide bleaching solution (pH 10.0) instead of the conventional ferric complex solution. The peroxide bleaching solution contained hydrogen peroxide (see TABLE III), chloride ion (see TABLE III), carbonate buffer (0.1 mol/l) and diethylenetriamine-penta(methylenephosphonic acid) sodium salt sequestering agent (1.5 mmol/l). The acidic stop solution contained sulfuric acid (0.18 mol/l) except in Comparison method C where it contained acetic acid (0.16 mol/l).

The residual silver in g/m$^2$ at maximum density after 60 seconds of bleaching was determined by conventional X-ray fluorescence techniques and is tabulated in TABLE III below. Also in TABLE III are the red, green and blue Dmin densities and ΔBlue Dmin relative to the conventional EKTACOLORRA-4 Process (Comparison A) as determined using conventional sensitometric procedures.

TABLE I

| PROCESSING STEP | TEMPERATURE (°C.) | TIME (seconds) |
|---|---|---|
| Color development | 35 | 45 |
| Bleach/fixing | 35 | 45 |
| Washing | 33 | 90 |

TABLE II

| PROCESSING STEP | TEMPERATURE (°C.) | TIME (seconds) |
|---|---|---|
| Color development | 35 | 45 |
| Acidic stop | 35 | 30 |
| Washing | 33 | 30 |
| Bleaching | 35 | 60 |
| Washing | 33 | 30 |
| Fixing | 35 | 60 |
| Washing | 33 | 120 |

TABLE III

| Comparison Method | Peroxide (mol/l) | Chloride (mol/l) | Dmax (Ag) | Dmin (Ag) | Red Dmin | Green Dmin | Blue Dmin | ΔBlue Dmin |
|---|---|---|---|---|---|---|---|---|
| A | 0 | 0 | 3.4 | 0.50 | 0.107 | 0.106 | 0.083 | 0 |
| B | 0 | 0 | 0.80 | 0.90 | 0.101 | 0.098 | 0.084 | 0.001 |
| C | 0 | 0 | 1.10 | 0.80 | 0.107 | 0.105 | 0.097 | 0.014 |
| D | 0.082 | 0.050 | 2.80 | 0.20 | 0.103 | 0.099 | 0.099 | 0.016 |
| E | 0.123 | 0.075 | 1.60 | 0.00 | 0.107 | 0.103 | 0.100 | 0.017 |
| F | 0.163 | 0.050 | 0.30 | 0.50 | 0.108 | 0.106 | 0.104 | 0.021 |
| G | 0.082 | 0.100 | 2.50 | 0.80 | 0.108 | 0.105 | 0.101 | 0.018 |
| H | 0.123 | 0.100 | 1.60 | 0.50 | 0.106 | 0.102 | 0.097 | 0.014 |
| I | 0.163 | 0.075 | 0.90 | 1.10 | 0.108 | 0.104 | 0.098 | 0.015 |
| J | 0.333 | 0.350 | 1.30 | 0.00 | 0.102 | 0.098 | 0.092 | 0.009 |

COMPARATIVE EXAMPLES

Samples of commercially available KODAK EKTACOLOR EDGE photographic paper were given a step wedge object exposure at 1/10 second with HA-50 and NP-11 filters, a 0.3 Inconel and a 3000K color temperature lamp on a 1B-sensitometer. Comparison method A utilized the conventional EKTACOLOR RA-4 Process bleach/fixing solutions and protocol shown in TABLE I. Comparison methods B and C utilized the conventional separate EKTACOLOR RA-4 bleaching and fixing solutions and protocol shown in TABLE II.

These data indicate that using the peroxide bleaching solutions provides comparable results to the use of the conventional ferric complex bleaching and bleach/fixing solutions (Comparison methods A–C). In addition, the data show that the methods using the separate bleaching and fixing steps produce higher Dmin stain due to high Blue record Dmin than the method using the bleach/fixing step (Comparison method A). No vesiculation was observed when the peroxide bleaching solutions were used.

Invention Example 1

The present invention was practiced by imagewise exposure of samples of KODAK EKTACOLOR EDGE photographic paper, and processed using the protocols shown in TABLE IV below. Hydrogen peroxide bleaching solutions were used for 60 seconds. Both acidic stop solutions contained sulfuric acid (0.18 mol/l), and the time of the second acidic stop was 60 seconds. All other steps were carried out at times and temperatures shown in TABLE I.

The processed film samples were analyzed as described above, and the ΔBlue Dmin relative to the conventional EKTACOLOR RA-4 Process was determined. These data are tabulated in TABLE V below.

TABLE IV

| Processing Step | Process A | Process B | Process C | Process D |
|---|---|---|---|---|
| Color Development | Yes | Yes | Yes | Yes |
| First Stop | Yes | Yes | Yes | Yes |
| Washing | Yes | Yes | Yes | Yes |
| Bleaching | Yes | Yes | Yes | Yes |
| Washing | Yes | Yes | No | No |
| Second Stop | No | Yes | Yes | Yes |
| Washing | No | No | Yes | No |
| Fixing | Yes | Yes | Yes | Yes |
| Washing | Yes | Yes | Yes | Yes |

TABLE V

| | | | ΔBlue Dmin Densities | | | |
|---|---|---|---|---|---|---|
| Bleaching Solution | $H_2O_2$ mol/l | Chloride mol/l | Process A | Process B | Process C | Process D |
| 1 | 0.082 | 0.05 | 0.0153 | 0.0148 | 0.0125 | 0.0115 |
| 2 | 0.123 | 0.075 | 0.0150 | 0.0143 | 0.0125 | 0.0097 |
| 3 | 0.163 | 0.1 | 0.0180 | 0.0128 | 0.0115 | 0.006 |

These results demonstrate that the use of a second acidic solution after bleaching lowers the blue Dmin, thus reducing the yellow Dmin stain when EKTACOLOR EDGE photographic paper is processed.

Invention Example 2

Samples of EKTACOLOR EDGE photographic paper were processed using Processes A and D of Example 1, and using various acids in both first and second acidic solutions. The samples were imagewise exposed, and bleached for 45 seconds with a bleaching solution comprising hydrogen peroxide (1%, 0.33 mol/l), chloride ions (0.1 mol/l), carbonate buffer (0.1 mol/l, pH 10) and the sequestering agent noted above (1.5 mmol/l). The first and second acid stop baths were used for 30 seconds each.

The residual silver ($g/m^2$) at maximum density was determined by X-ray fluorescence and tabulated in TABLE VI below. Also included in TABLE VI are the blue Dmin values for all samples.

TABLE VI

| Acid | Acid Concentration (mol/l) | pH | Process A Dmax (Ag) | Process D Dmax (Ag) | Process A Blue Dmin | Process D Blue Dmin |
|---|---|---|---|---|---|---|
| Process RA-4 | 0 | — | 0.024 | — | 0.092 | — |
| Acetic* | 0.16 | 4.75 | 0.037 | — | 0.100 | — |
| Acetic* | 0.16 | 2.75 | 0.015 | — | 0.90 | — |
| Sulfuric* | 0.18 | 0.67 | 0.003 | — | 0.087 | — |
| Sulfuric | 0.18 | 0.67 | 0.021 | 0.026 | 0.102 | 0.093 |
| Acetic | 0.16 | 4.75 | 0.019 | 0.014 | 0.119 | 0.109 |
| Acetic | 0.16 | 2.75 | 0.012 | 0.003 | 0.104 | 0.095 |
| Glycolic | 0.10 | 2.35 | 0.007 | 0.019 | 0.104 | 0.096 |
| Maleic | 0.10 | 1.45 | 0.015 | 0.012 | 0.102 | 0.093 |
| 2 Cl-propionic | 0.10 | 1.84 | 0.030 | 0.019 | 0.101 | 0.092 |
| Nitric | 0.10 | 1.01 | 0.014 | 0.010 | 0.102 | 0.094 |
| Citric | 0.10 | 1.96 | 0.020 | 0.024 | 0.102 | 0.095 |
| Succinic | 0.10 | 2.49 | 0.016 | 0.016 | 0.103 | 0.097 |
| Methanesulfonic | 0.10 | 0.90 | 0.014 | 0.004 | 0.102 | 0.093 |

*Used with conventional EKTACOLOR RA-4 bleaching solution

These data show that various acids can be used in the method of this invention to reduce blue record Dmin. Thus, a second acidic solution must be used after the peroxide bleaching step.

Invention Example 3

A similar process as Example 1 was carried out using the bleaching solution and time of Example 2, and the time for using the second acidic bath was varied up to 120 seconds. A reduction of blue record Dmin was determined at various times of processing, but the optimum reduction was achieved at a treatment time in the second acidic bath of about 30 seconds.

The invention has been described in detail with particular reference to preferred embodiments thereof, but it will be understood that variations and modifications can be effected within the spirit and scope of the invention.

We claim:

1. A method for photoprocessing comprising, in order:

A) color developing an imagewise exposed color photographic paper comprising at least one predominantly silver chloride photographic emulsion, said paper having a total silver coverage of less than or equal to 1 $g/m^2$, B) stopping color development by contacting said paper with a first acidic solution having a pH of less than or equal to 4, C) bleaching said paper with a peroxide bleaching composition comprising a peroxide bleaching agent, and chloride ions, D) contacting said bleached paper with a second acidic solution having a pH of less than or equal to 5, and E) fixing said paper.

2. The method of claim 1 wherein said bleaching agent is hydrogen peroxide.

3. The method of claim 1 wherein said bleaching solution comprises said chloride ions in an amount of from about 0.01 to about 2 mol/l.

4. The method of claim 3 wherein said bleaching solution comprises said chloride ions in an amount of from 0.05 to about 1 mol/l.

5. The method of claim 1 wherein said bleaching solution has a pH of from about 8 to about 11.

6. The method of claim 1 wherein said bleaching solution further comprises a first sequestering agent that is an organic phosphonic acid or salt thereof having the structure (I):

$$R^1N(CH_2PO_3M_2)_2$$

or the structure (II):

$$R^2R^3C(PO_3M_2)_2$$

wherein $R^1$ is hydrogen, an alkyl group of 1 to 12 carbon atoms, an alkylaminoalkyl group wherein the alkyl group has 1 to 12 carbon atoms, an alkoxyalkyl group of 1 to 12 carbon atoms, a cycloalkyl group of 5 to 10 carbon atoms, an aryl group of 6 to 10 carbon atoms, or a 5- to 10-membered heterocyclic group, $R^2$ is hydrogen, an alkyl group of 1 to 12 carbon atoms, an aryl group of 6 to 10 carbon atoms, a cycloalkyl group of 5 to 10 carbon atoms, a 5- to 10-membered heterocyclic group, $—PO_3M_2$, or $—CHR^4PO_3M_2$, $R^3$ is hydrogen, hydroxyl, an alkyl group of 1 to 12 carbon atoms or $—PO_3M_2$, $R^4$ is hydrogen, hydroxyl, an alkyl group of 1 to 12 carbon atoms or $—PO_3M_2$, and M is hydrogen or a water-soluble monovalent cation.

7. The method of claim 6 wherein said first sequestering agent is 1-hydroxyethylidene-1,1-diphosphonic acid, nitrilo-N,N,N-trimethylenephosphonic acid, or diethylenetriamine-N-N,N',N",N"-penta(methylenephosphonic acid) or salts thereof.

8. The method of claim 1 wherein said first sequestering agent is present in an amount of from about 0.0005 to about 0.03 mol/l.

9. The method of claim 1 wherein said bleaching solution further comprises a second sequestering agent having one of the following structures:

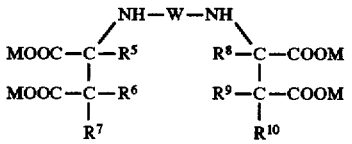

(III)

wherein $R^5$, $R^6$, $R^7$, $R^8$, $R^9$ and $R^{10}$ are independently hydrogen, hydroxy, an alkyl group of 1 to 5 carbon atoms, an cycloalkyl group of 5 to 10 carbon atoms, or an aryl group having 6 to 10 carbon atoms in the aromatic nucleus, M is hydrogen or a water-soluble monovalent cation, and W is a covalent bond or a divalent aliphatic linking group,

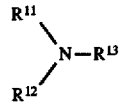

(IV)

wherein at least two of $R^{11}$, $R^{12}$ and $R^{13}$ are carboxymethyl groups, and the third group is hydrogen,

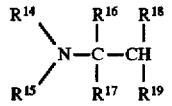

(V)

wherein one of $R^{14}$ and $R^{15}$ is a carboxymethyl or 2-carboxyethyl group, and the other is hydrogen, and $R^{16}$, $R^{17}$, $R^{18}$ and $R^{19}$ are independently hydrogen, an alkyl group of 1 to 5 carbon atoms, hydroxy, carboxymethylamino, carboxy or carboxymethyl, provided that only one of $R^{16}$, $R^{17}$, $R^{18}$ and $R^{19}$ is carboxy, carboxymethylamino or carboxymethyl,

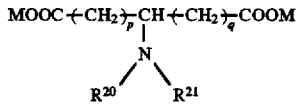

(VI)

wherein one of $R^{20}$ and $R^{21}$ is hydrogen, and the other is an alkyl group of 1 to 5 carbon atoms, a hydroxyethyl group, a carboxymethyl group or a 2-carboxyethyl group, M is as defined above, and p and q are independently 0, 1 or 2 provided that the sum of p and q does not exceed 2, or

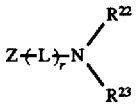

(VII)

wherein

Z represents an aryl group of 6 to 10 carbon atoms in the nucleus or a heterocyclic group having 5 to 7 carbon, nitrogen, sulfur and oxygen atoms in the nucleus, L is a divalent aliphatic linking group, one of $R^{22}$ and $R^{23}$ is hydrogen, and the other is an alkyl group of 1 to 5 carbon atoms, a carboxyalkyl group of 2 to 4 carbon atoms or a hydroxy-substituted carboxyalkyl group of 2 to 4 carbon atoms, and r is 0 or 1.

10. The method of claim 9 wherein said second sequestering agent is present in an amount of from about 0.001 to about 0.05 mol/l.

11. The method of claim 9 wherein said second sequestering agent is N,N-ethylenediaminedisuccinic acid, N,N-ethylenediaminediacetic acid or N-(2-carboxyethyl)aspartic acid.

12. The method of claim 1 wherein said paper comprises a silver halide emulsion having more than 90 mol % silver chloride and less than 5 mol % silver iodide.

13. The method of claim 1 wherein said paper comprises a silver halide emulsion having more than 95 mol % silver chloride.

14. The method of claim 1 wherein said peroxide bleaching agent is present in said bleaching solution in an amount of from about 0.15 to about 3 mol/l.

15. The method of claim 1 wherein said first acidic solution has a pH of up to about 4.

16. The method of claim 1 wherein said second acidic solution has a pH of up to about 4.

17. The method of claim 1 wherein said paper has red, green and blue color records, each of said records having a silver chloride emulsion having at least 90 mol % silver chloride.

18. The method of claim 1 wherein each of steps B and D are carried out independently for less than 90 seconds.

19. The method of claim 18 wherein each of steps B and D are carried out independently for from about 20 to about 40 seconds.

20. The method of claim 1 wherein said first and second acidic solution comprise an acid independently selected from the group consisting of sulfuric acid, acetic acid, glycolic acid, maleic acid, propionic acid, nitric acid, methanesulfonic acid, 2-chloropropionic acid, 3-chloropropionic acid, citric acid and succinic acid.

* * * * *